United States Patent [19]

Bovio et al.

[11] 4,200,778

[45] Apr. 29, 1980

[54] ELECTRIC KEYBOARD OF SNAP-CONTACT TYPE

[75] Inventors: Michele Bovio, Banchette; Pietro Castellano, Castellamonte, both of Italy

[73] Assignee: Ing. C. Olivetti & C., S.p.A., Ivrea, Italy

[21] Appl. No.: 907,491

[22] Filed: May 19, 1978

[30] Foreign Application Priority Data

May 23, 1977 [IT] Italy ..... 68166 A/77

[51] Int. Cl.[2] ..... B41B 9/02; H01H 1/06

[52] U.S. Cl. ..... 200/159 B; 200/5 A; 200/275

[58] Field of Search ..... 200/159 B, 5 A, 275

[56] References Cited

U.S. PATENT DOCUMENTS

| | | | |
|---|---|---|---|
| 3,800,104 | 3/1974 | Lien et al. | 200/275 |
| 3,899,648 | 8/1975 | Murata | 200/5 A |
| 4,084,071 | 4/1978 | Smith | 200/159 B |
| 4,118,610 | 10/1978 | Purssell et al. | 200/275 |

FOREIGN PATENT DOCUMENTS

| | | | |
|---|---|---|---|
| 545991 | 2/1974 | Switzerland | 200/5 A |

*Primary Examiner*—Steven L. Stephan

[57] ABSTRACT

A keyboard comprises a plurality of keys which, when depressed, elastically deform conductive laminae which thereby go with a snap action from a stable configuration to an unstable configuration to complete an electrical circuit associated thereto. Each lamina has the form of two mutually transverse pairs of parallel edge strips spanned by a diagonal strip and the edge strips have permanent bends set into them such that the diagonal strip is bowed in the stable configuration towards the corresponding key. A fixed contact on the lamina is located adjacent one end of the diagonal strip and a movable contact is located in the central region of the diagonal strip. A single key actuates two identical laminae, one through an actuator resiliently coupled to the key and the other through an actuator fixed to the key.

21 Claims, 10 Drawing Figures

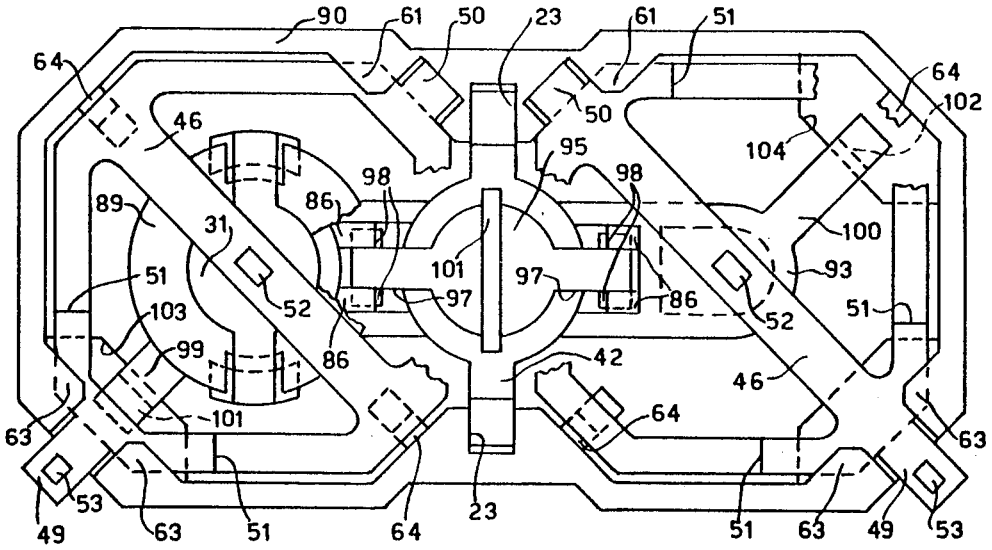
FIG. 9
FIG. 7
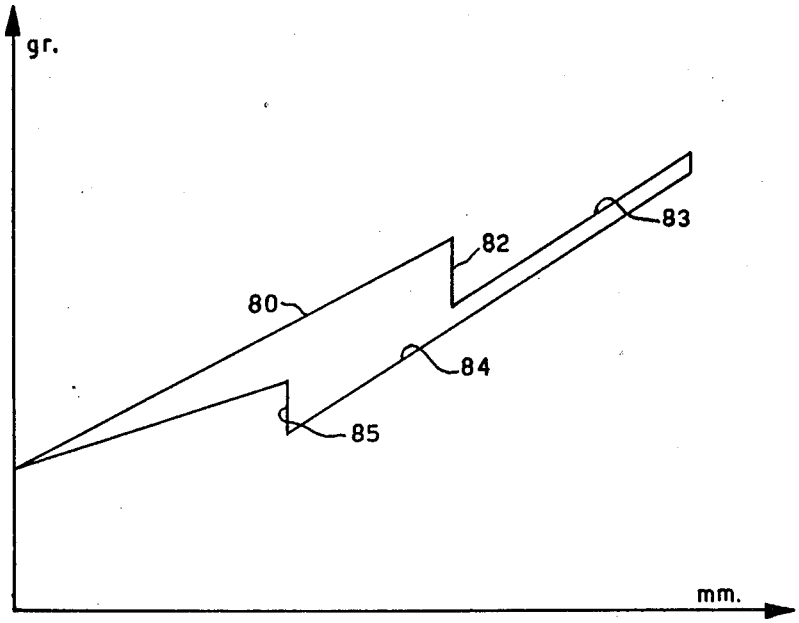

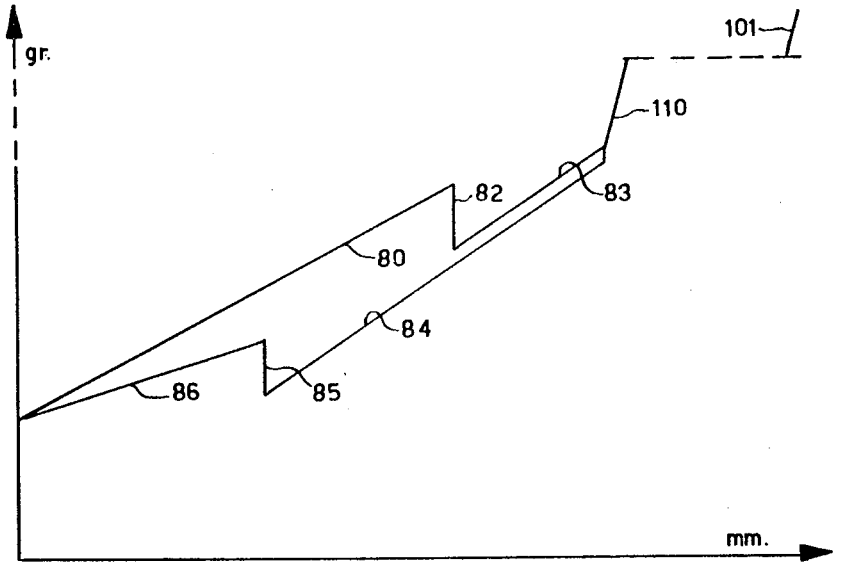
FIG. 10
FIG. 8
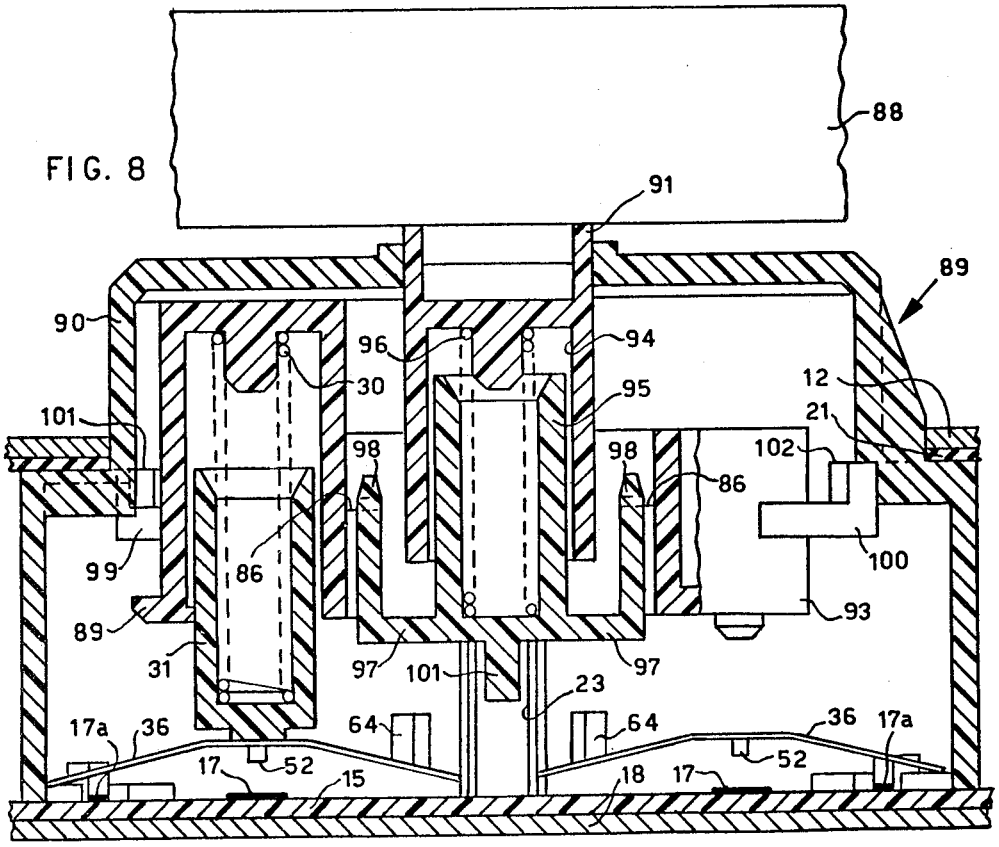

ELECTRIC KEYBOARD OF SNAP-CONTACT TYPE

BACKGROUND OF THE INVENTION

The present invention relates to an electric keyboard having snap contacts.

There are many keyboards in which the depression of a key leads to an electrical connection between two areas of a circuit effected by the snap action of metallic laminae. These laminae are very elastic and, for example, are given a bow-shaped or dome-shaped form. Each lamina is supported at the edges and depression of a key leads to the compression of the lamina through an intermediary spring. Its deformation into an unstable configuration leads to the sudden production of a curvature in the opposite direction to that present initially and to the formation of the desired electrical connection. On releasing the key the elasticity of the material overcomes the load of the intermediary spring and restores the lamina to its initial stable form.

Known keyboards of this type have the advantage of being economical. However, the working load of the key is found to be greater than that in the best release keyboards; besides this, the release behaviour of the individual key depends essentially on the physical and dimensional characteristics of the material employed for the lamina and on its processing, with particular reference to wear of the stamps used in manufacture. In order to ensure uniform ergonomic conditions of different keys in a keyboard, it is generally necessary to test the keys, which means a considerable increase in the cost of the keyboard. Finally, the present values of the working load exclude the use of these keyboards in sectors of typing machines and apparatus for data transmission where the ergonomic demands by users are very severe.

SUMMARY OF THE INVENTION

The object of the present invention is to provide a keyboard with snapacting keys which employ deformable laminae, whose operating load is very low and whose ergonomic behaviour is uniform even with materials from different batches and treated in equipment having different degrees of wear.

According to the present invention there is provided a keyboard comprising a key which, when depressed, elastically deforms a conductive lamina which thereby goes with a snap action from a stable configuration to an unstable configuration and wherein an electrical circuit is completed through the lamina in only one of the two configurations, the lamina having the form of two mutually transverse pairs of parallel edge strips spanned by a diagonal strip, the edge strips having permanent bends set into them such that the diagonal strip is bowed in the stable configuration towards the key.

This structure, when used with a standard key, provides very flexible laminae by using relatively long strips of limited transverse dimensions and such that they are not very sensitive to changes in the thickness of the material. Also, the use of simple folds in the lateral strips makes the lamina fairly insensitive to the various degrees of wear of the stamps used in manufacture.

BRIEF DESCRIPTION OF THE DRAWINGS

The invention will be described in more detail, by way of example, with reference to the accompanying drawings, in which:

FIG. 7 is a work diagram of the key of FIG. 3;

FIG. 8 is an enlargement of a different form of key of the keyboard in FIG. 1;

FIG. 9 is a view from below of the form of key of FIG. 8;

FIG. 10 is a work diagram of the form of key of FIG. 8.

GENERAL DESCRIPTION

Figure 1:
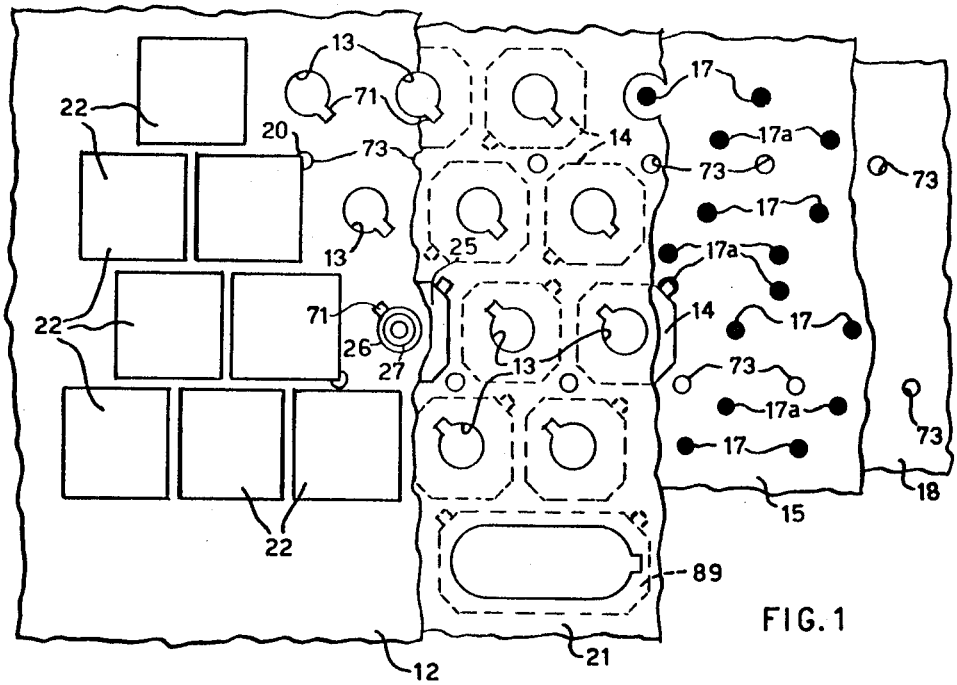
FIG. 1 is a plan view, partially in section, of a keyboard embodying the invention.

With reference to FIG. 1, a keyboard with contacts comprises a frame 12 provided with holes 13 into which are inserted individual keys 14. The keys 14 rest on the insulating support of a printed circuit 15, which for each key 14 is furnished with a pair of conducting areas 17 and 17*a*. The keyboard finally comprises a bottom closure 18; screws 20 hold the different parts together and a rubber lining 21 renders the return to rest of the keys 22 noiseless.

Figure 3:
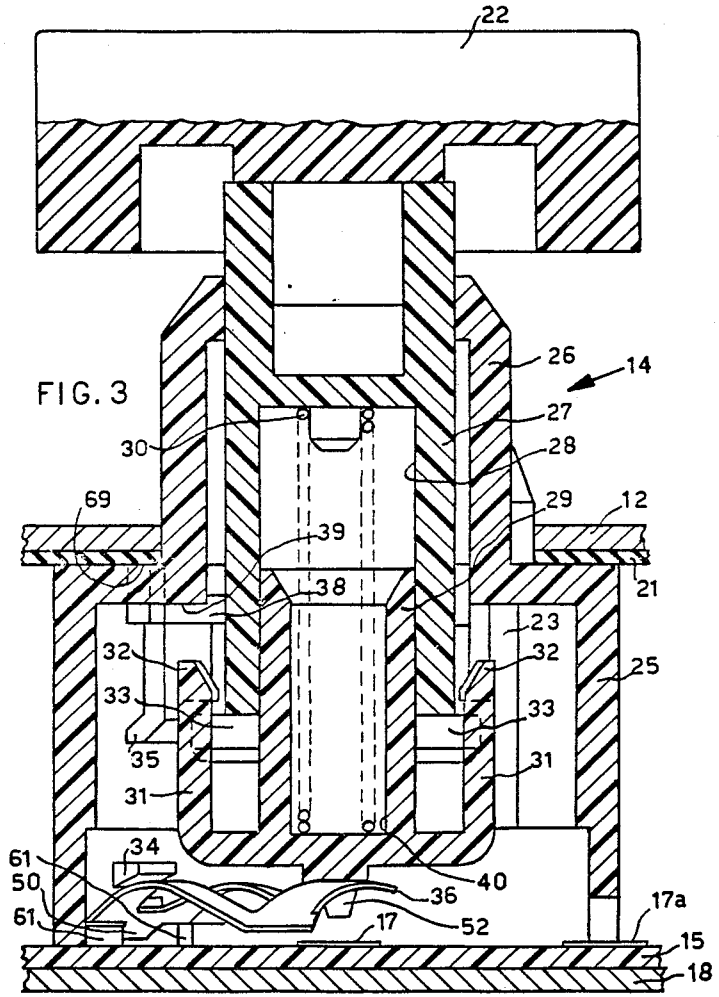
FIG. 3 is a section of one key of the keyboard, on an enlarged scale compared with that shown in FIG. 1.

Each key 14 (FIG. 3) comprises a body 25, substantially parallelepipedal with a square section having bevelled corners internally hollow and having an open bottom. This body 25 is provided, in its upper portion, with a reduced cylindrical part 26, and in its lower part and internally with two rectangularsection guides 23 (FIG. 4), which guide in a sliding manner a key shank 27 supporting a key button 22 (FIG. 3). In a cavity 28 of the shank 27 there slides an actuator 29, which is urged downwardly by a spring 30. Two arms 31 of the actuator 29 are guided in grooved flanges 33 of the runner 29 and can be stopped by these by means of two lugs 32, while two stops 34 are provided to hold towards the base two arms 35 of the runner 27. The lower part of the body 25 houses a metallic lamina 36, which, by compressing the spring 30, normally holds the key 22 in the raised position, with a crossbar 38 of the arms 35 held against a check surface 39 of the body 25.

The actuator 29, the shank 27 and the body 25 are of thermoplastic material and are assembled in a very simple manner. In particular, having inserted the spring 30 in the cavity 40 of the actuator 29, the latter is inserted in the cavity 28 of the leg 27. The lugs 32 of the arms 31 are sprung apart by the edges of flanges 33, whereby the arms 31 enter corresponding grooves 41. The shank 27 is in turn inserted in the bottom of the body 25, guided by two lugs 42 in the guides 23. By pressing the arms 35 against the stops 34 the latter are overcome, thus completing the assembly of the parts.

Figure 5:
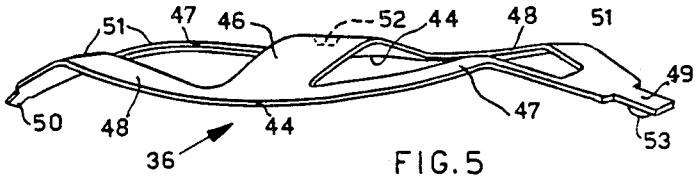
FIG. 5 is a perspective view of a detail of FIG. 4.
Figure 4:
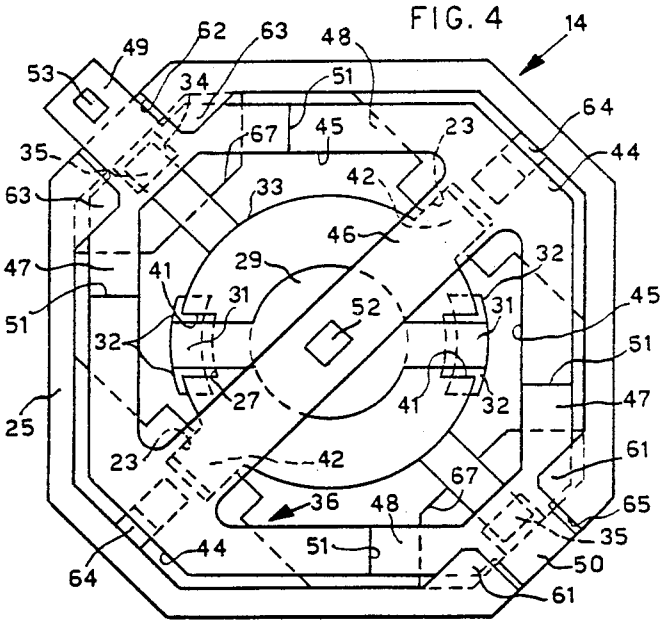
FIG. 4 is a bottom view of the form of key shown in FIG. 3.

With reference to FIGS. 4 and 5, the lamina 36 is sheared from a spring steel ribbon of 0.1 mm thickness.

The lamina is of generally square outline but with bevelled corners and comprises two opposite and parallel edge strips 47 and two opposite and parallel edge strips 48 connected by two corner strips 44 at 45° to the edge strips. Two generally triangular windows 45 are cut through the lamina so that two diagonal opposite corner strips are spaced by a diagonal strip 46. Lugs 49 and 50 project outwardly from the other two corner strips. Each edge strip has a bend line 51 across the width of the strip nearer to the corner strips with lugs than the corner strips which are spanned by the diagonal strip 46. On the underside of the lamina at the centre of the diagonal strip 46 and in the lug 49 are soldered contact pads 52 and 53 respectively for contact with the printed circuit areas 17 and 17*a*.

The bends 51 of the two pairs of strips 47 and 48 (FIG. 5) are all downwardly concave which causes the strip 46 to bow downwardly.

The lamina 36 is located in the body 25 (FIG. 4) with the lug 50 engaged therewith by bearing on an edge 65. The lug 50 is shorter than lug 49 and it is lodged in a corner groove 60 and with parts of the strips 47 and 48 next to the lug 50 resting downwards against two lugs 61 of the body 25. The lug 49 is lodged in a groove 62 and may be held by two lugs 63 of the body 25 without being prevented in its upward movement. The corner strips 44 at the ends of the diagonal strip 46 bear against two corresponding inclined surfaces 64 of the body 25, which cause further bowing of the strip 46 and the raising of the actuator 29 and shank 27, owing to the engagement of lug 50 with body 25.

Figure 2:
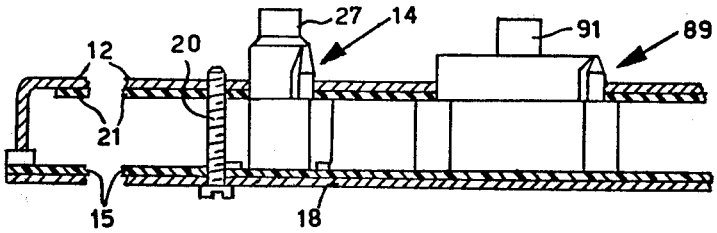
FIG. 2 is a schematic sectional elevation of the keyboard according to FIG. 1.
Figure 6:
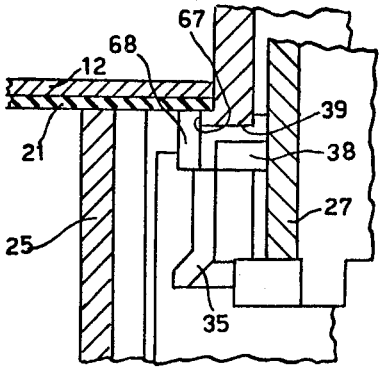
FIG. 6 is a section of a detail in FIG. 4.

The keys 14 are assembled in the keyboard by inserting the cylindrical parts of the bodies 25 in the holes 13 (FIG. 1) of the frame 12, with a small lug 70 engaged in a corresponding notch 71. Through two windows 67 (FIG. 6) in the bodies 25, through the surfaces 39, there protrude upwards upper extensions 68 of the arms 35, which thus bear against the rubber lining 21 instead of by the surfaces 39. Having arranged the printed circuit 15 (FIG. 3) against the lower edges of flanges 25, (FIG. 2) the contact pads 53 rest elastically on the areas 17*a* while the pads 52 face the areas 17 (FIG. 1). The screw 20, passing through bevelled corners of two bodies and screwd through holes 73 hold all parts together. The key buttons 22 are then fitted onto the shanks 27.

With further reference to the diagram of FIG. 7, showing the force in grams as a function of the displacement of the key 22 expressed in mm, the key 14 is normally pushed upwards against the stops by a force generated by the lamina 36 of about 20 gm. Initial depression of key 14, line 80, induces gradual compression of the spring 30, with a rising force on the key 14, until there is a sudden yield of the diagonal strip 46 of the lamina 36, at a force of about 60 gm, line 82 and at a depression of about 2.6 mm for the key 14. At this point there occurs the snap contact of the pad 52 (FIG. 3) on the area 17 and unfailing electrical contact is made between the two areas 17*a* and 17. The spring 30 lengthens and the load decreases; further depression of the key 14 to a travel of about 4 mm, line 83, causes a further increase of the load on the key without any other practical effect. Later release of the key, line 84, by extending the spring 30, lowers the load on the key 14 down to a value of about 30 gm and a position of about 1.5 mm, at which the elastic reaction of the lamina 36 overcomes the action of the spring 30 on the actuator 29, with a snap action which returns the strip 46 to its initial conformation and compresses the spring, thus making the load on the key 14 increase, line 85. Further release of key 22 leads to final lowering of the load to the normal rest conditions, with the cushioned and silent abutment of the protrusion 69 of the shank 27 against the rubber lining 21.

In consistent lots of laminae 36, coming from various parts of steel stock and produced by presses having different degrees of wear, the ergonomic conditions of key functioning described above having turned out to be closely comparable among themselves. The forces on the keys 14 for snap deformations of the laminae 36 and for the contact are sufficiently low, the extent of travel is equal among them, and comparable respectively with analogous loads in the best electro-mechanical keyboards. As a result, this type of keyboard may also be used in typewriters, without any appreciable difference being noticed by the operators with respect to motor powered keyboards.

With refernce to FIG. 8, there is shown at 89 another form of key according to the invention which may also be used to obtain special functions such as "repeat". This comprises a parallelepipedal body 90 with a rectangular section, having the same width as the body 25 but twice the length, which houses two laminae 36 in the manner already described for the body 25. The shank 91 of the key 88 is also guided by rectangular guides 23 of the body 90, and is lengthened in form. This is provided on one side with a cylindrical body 89 with a cavity in which are lodged the spring 30 and the actuator 31 in contact with the lamina 36, as described above for the form 14. On the other side, the shank 91 has a rigid actuator 93 arranged above the second lamina 36 at a distance greater than the stroke required by the leg 91 to make the first lamina 36 snap down.

In its central part the shank 91 is provided with a cylindrical central cavity 94, in which is lodged a small cylinder 95, this also being hollow and urged away from the key button 88 by a spring 96. Two U-shaped arms 97 of the small cylinder 95, by means of two pairs of lugs 98, opposed by two pairs of shoulders 86 of the shank 91, prevent exit of the small cylinder 95 from the cavity 94. The shank 91 finally has two horizontal arms 99 and 100 (FIG. 9) which come out radially from the body 89 and the actuator 93, at 45° to the horizontal axis of the body 90. These arms 99 and 100 are provided with two upper parts 101 and 102 which protrude through the windows 103 and 104 of the body 90 and are stopped by the rubber lining 21 of the keyboard.

Referring again to the diagram of FIG. 10, normal depression of key 88 leads initially to contact of lamina 36 below the actuator 31, as previously described, until the base 105 of the small cylinder 95 is held against the support of the printed circuit 15. Further lowering of the shank 91, as it approaches the small cylinder 95, compresses the spring 96 and then brings the rigid actuator 93 into contact with the other lamina 36, snapping it down to contact the pad 52 with the underlying area 17. The pre-load of the spring 96, line 110, equal to about 8 times that of the spring 30 gives the feeling of execution of the function "repeat" and the second contact occurs at about 4.8 mm depression of the key 89 and has not been represented on FIG. 10.

The shank 91 can be mounted in the body 90 in a position rotated by 180° with respect to that described, thus positioning the rigid actuator 93 above the first lamina 36 and the actuator 31 above the second lamina. The protrusions 101 and 102 of the arms 99 and 100 protrude from the holes 104 and 103 respectively of the body 90. With this arrangement it is possible to obtain, on two different pairs of adjacent areas 17 and 17*a* normal and "repeat" functions.

What we claim is:

1. A keyboard comprising an electrical circuit and an elastically deformable lamina for going with a snap action from a stable configuration to an unstable configuration to complete said electrical circuit in only one of said configurations, wherein said lamina has the form of two mutually transverse pairs of parallel edge strips said strips converge to two corners integral with opposite ends of a diagonal strip and the edge strips have permanent bends set into them to bow the diagonal strip in the stable configuration of the lamina.

2. A keyboard according to claim 1, further comprising a key depressable for deforming said lamina and wherein the bends on said edge strips bow the diagonal strip toward the key in the stable configuration of said lamina.

3. A keyboard according to claim 2, further comprising a compression spring connecting said key with said diagonal strip to deform the bow thereof after a stroke of said key loading said spring until a predetermined load.

4. A keyboard according to claim 1, wherein said electric circuit comprises two conductors, the lamina is conductive and comprises a first contact located on another corner of the edge strips remote from the ends of the diagonal strip and a second contact located in the central region of the diagonal strip, and wherein the first contact is permanently into contact with one of the two conductors and the second contact on the lamina is spaced from the other conductor in said stable configuration but makes contact therewith in said unstable configuration.

5. A keyboard according to claim 4, comprising a hollow body to house said lamina, wherein said first contact is located on a lug projecting at said another corner of the lamina, wherein said hollow body has an internal section corresponding substantially to the outline of the lamina and wherein said body includes an aperture at a corner thereof through which passes said projecting lug.

6. A keyboard according to claim 1, wherein said lamina is of substantially square outline and said corners are bevelled perpendicularly to said diagonal strip.

7. A keyboard according to claim 6, wherein said lamina comprises at least one lug on one of the corners of said transverse strips remote from said bevelled corners, further comprising a support of said lamina including means engaging said lug and two inclined surfaces on which bear said bevelled corners for further bowing said diagonal strip.

8. A keyboard according to claim 1, further comprising another lamina identical to said deformable lamina, a hollow body to house said two laminae, a single key, guide means on said hollow body to guide said key and means carried by said key for actuating said two laminae, said actuating means comprising two actuators of which a first one actuates a first of said two laminae after a predetermined stroke of the key and the second actuator actuates a second of said two laminae after an extra stroke of the key greater than said first stroke.

9. A keyboard according to claim 8 wherein the first actuator comprises spring means connecting resiliently said key with said first lamina to actuate said first lamina after a predetermined load of said spring means.

10. A keyboard according to claim 1, comprising a plurality of keys for actuating corresponding laminae each identical to said deformable lamina, wherein each of said keys comprises an arrest stop, and wherein said keys are mounted through a panel having a resilient layer on its underside and against which the arrest stop of the keys bear to cushion and silence return of the keys as their laminae spring back to their stable configurations.

11. A keyboard according to claim 1, wherein the bends in the edge strips each comprise a single transverse bend in each of said strips adjacent one of the ends of the diagonal strip.

12. A keyboard according to claim 2 further comprising a hollow body to house said lamina, wherein said hollow body has an internal section shaped as the outline of the lamina and comprises guide element for guiding the key adjacent the two corners of said lamina remote from the ends of said diagonal strip.

13. A keyboard according to claim 5, wherein the lamina comprises a further corner opposite said another corner and another lug projecting from said further corner, and said hollow body comprises means engaging said other lug, and two arrest elements for arresting the ends of said diagonal strip in the stable configuration of the lamina.

14. A keyboard according to claim 13, further comprising a key depressable for deforming said lamina, and guide means on said hollow body for guiding said key adjacent said one and said other lug.

15. A keyboard according to claim 13, further comprising an actuator cooperative with a guide element on said key for guiding said actuator, and a spring element resiliently connecting said actuator with said key for causing the snap action of said lamina.

16. An electric keyboard comprising two electric circuits, two laminae associated to said circuits and elastically deformable with a snap action from a stable configuration to an unstable configuration to complete said electrical circuits through the lamina in only one of its two configurations, a hollow body to house said two laminae, a depressable key, guide means on said hollow body for guiding said key and means connecting said key with said laminae to snap a first of said two laminae into its unstable configuration after a normal stroke of said key and the second of said two laminae after an extra stroke of said key, said connecting means comprising a first actuator cooperative with said first lamina, a spring element resiliently connecting said actuator with said key for causing the snap action of said first lamina at said normal stroke and a second actuator connected substantially rigidly to said key for causing the snap action of said second lamina at said extra stroke.

17. An electric keyboard according to claim 16 further comprising spring means operative on said key upon depression thereof over the normal stroke to increase the resistance of the key when the key has been depressed over said normal stroke.

18. A keyboard according to claim 16, wherein the key is mountable on the guide means of said hollow body in either of two orientations related by a rotation of 180 degrees, the first and second actuators actuating first and second ones respectively of the two laminae in one orientation and the second and first ones respectively of the two laminae in the other orientation.

19. A keyboard comprising an electrical circuit and an elastically deformable lamina for going with a snap action from a stable configuration to an unstable configuration to complete said electrical circuit in only one of said configurations, wherein said lamina is of substantially square outline and comprises two substantially triangular windows cut from the lamina and defining a diagonal strip and two opposite pairs of edge strips, wherein both said edge strips have ends common to the ends of the diagonal strip and each of said strips has a permanent bend set into it to bow the diagonal strip in the stable configuration of the lamina.

20. An electric keyboard according to claim 19, further comprising a hollow body having two adjacent internal square sections corresponding substantially to the outline of said lamina and accommodating two laminae identical to said lamina, a depressable key, guide means on said hollow body for guiding said key and means connecting said key with said laminae to snap a first of said two laminae into its unstable configuration after a normal stroke of said key and the second of said two laminae after an extra stroke of said key.

21. A keyboard according to claim 20 wherein said connecting means comprise a first actuator for actuating a first lamina of said two laminae by way of resilient means connected to the key, a second actuator fixed to said key which only acts on a second lamina of said two laminae after the first lamina has been snapped into its unstable configuration owing to a predetermined load of said resilient means determined by said normal stroke and spring means to increase the load on said key when the key has been depressed over said normal stroke.

* * * * *